United States Patent [19]

Abeshouse

[11] Patent Number: 4,906,216

[45] Date of Patent: Mar. 6, 1990

[54] PAPER SPINNING TOP

[76] Inventor: Matthew Abeshouse, 7 Pine Hill Rd., Woodbridge, Conn. 06525

[21] Appl. No.: 265,943

[22] Filed: Nov. 2, 1988

[51] Int. Cl.[4] ..... A63H 1/00; A63H 1/22

[52] U.S. Cl. ..... 446/256; 446/243; 446/264; 273/147

[58] Field of Search ..... 446/256–266, 446/238, 239, 213–218, 243; 273/147 R

[56] References Cited

U.S. PATENT DOCUMENTS

| | | | |
|---|---|---|---|
| 547,764 | 10/1895 | Boyum | 446/256 |
| 1,368,855 | 2/1921 | Stemons | 446/214 |
| 1,645,702 | 10/1927 | Ischinger | 446/217 |
| 1,783,627 | 2/1930 | Raimondi | 446/256 |
| 1,785,474 | 12/1930 | Allen | 446/217 |
| 2,879,066 | 3/1959 | Sutherland | 446/256 |
| 2,945,696 | 7/1960 | Johanningmeier | 446/256 |
| 2,991,585 | 7/1961 | Drees | 446/266 |
| 3,083,498 | 4/1963 | Kelley | 446/256 |
| 4,363,487 | 12/1982 | Hall | 273/147 |

FOREIGN PATENT DOCUMENTS

| | | | |
|---|---|---|---|
| 1247812 | 10/1960 | France | 446/217 |
| 97306 | 1/1961 | Norway | 446/217 |
| 1287151 | 8/1972 | United Kingdom | 446/218 |

*Primary Examiner*—Robert A. Hafer
*Assistant Examiner*—Michael Brown
*Attorney, Agent, or Firm*—Bachman & Lapointe

[57] ABSTRACT

The present invention relates to a top which may be used as a toy and/or as a marketing promotional tool. The top has a base member with a central aperture, at least two bendable arms, each having an aperture for receiving a stem member, and a stem member for holding the arms in position relative to the base member and for acting as a pivot.

18 Claims, 2 Drawing Sheets

PAPER SPINNING TOP

BACKGROUND OF THE INVENTION

The present invention relates to a new and novel top suitable for use as a toy and as an advertising device.

Tops have been popular toys for quite some time. Many different top constructions are known in the art. U.S. Pat. No. 3,083,498 to Kelley illustrates one of the simplest top constructions known in the art. The Kelley top has an annular body with an axial hole, an annular resiliently deformable member anchored in the hole and a stem member formed from a ball point pen. The top is intended to make designs on the paper as it spins.

A more complex game top is illustrated in U.S. Pat. No. 4,363,487 to Hall. The top comprises a polygonal shaped plate having indicia printed on at least one side, a pair of hemispherical domes on opposite sides of the plate and a spindle extending from each dome. While the plate may be formed from a sheet of cardboard coated with a hot-melt adhesive, the dome and spindle assemblies are formed from a polymeric material. The dome and spindle assemblies are joined to the plate by a heat sealing technique. Consequently, once assembled, this top could not be disassembled for storage and then re-assembled for later use.

U.S. Pat. No. 2,945,696 to Johanningmeier illustrates a top formed from a match book. In this design, each match book cover has an aperture. The pivot member is formed by one of the matches inserted through the holes in the covers. Obviously, this type of top is not suitable for use by small children.

Accordingly, it is an object of the present invention to provide a new and novel top construction.

It is a further object of the present invention to provide a top as above which is relatively easy to assemble.

It is still a further object of the present invention to provide a top as above which may be used as a toy and which is safe for use by children.

It is yet a further object of the present invention to provide a top as above which may be used as part of an advertising promotion.

These and other objects and advantages of the present invention may be seen from the following description and drawings in which like reference numerals depict like elements.

SUMMARY OF THE INVENTION

The foregoing objects and advantages are accomplished by the spinning top of the present invention which comprises a base member having an aperture through which a stem member having a relatively pointed end could be inserted and at least two arms hingedly joined thereto. The base member and the arms are each formed from a flexible material such as paper, light cardboard, or a plastic material. For reasons which will become more clearer hereinafter, each arm has an aperture substantially adjacent its outermost end.

To assemble the top, a first arm is bent into a desired configuration and the stem member inserted therethrough. Then the second arm is bent and the stem member is inserted through its aperture. Finally, the stem member's pointed end is passed through the aperture in the base member. If desired, a protective tip member may be placed over the relatively pointed end of the stem member so that a child is not hurt by it. The protective member, in addition to its safety function, may serve as a retainer for holding the stem member in position relative to the base member and as a weight for increasing the top spin rate.

As will be seen from the following discussion, the top of the present invention can have a wide variety of shapes. In addition, the top of the present invention lends itself to use in a wide variety of marketing applications such as cereal boxes, greeting cards, books, posters, magazines, record albums or the like. Suitable printed indicia for marketing products can be applied to the top components.

DETAILED DESCRIPTION OF THE INVENTION

Figure 1:
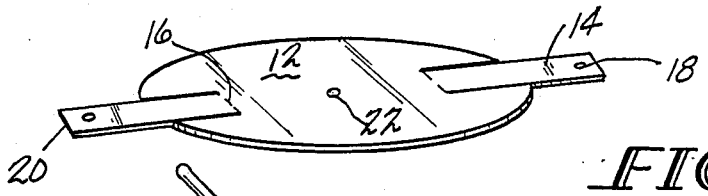
FIG. 1 is a plan view of a base member for a two arm top.

As previously discussed, it is an aim of the present invention to provide a top which is relatively easy to assemble and use. It is a further goal to provide a top which is relatively inexpensive to produce and which lends itself to use as a toy and in a wide variety of marketing applications.

Referring now to the drawings, the top 10 has a substantially planar base member 12 and two or more arms 14 spaced about its periphery. Generally, the arms 14 are spaced about the periphery equi-distant from each other. Each arm 14 is joined at one end 16 to the base member 10 in a way which permits the arm to be moved relative to the base member. For example, as shown in FIGS. 1–4, the arm 14 may be a continuation of a portion of the base member. Alternatively, suitable hinge means not shown may be placed between the end 16 of the arm and the base member.

The base member 12 and the arms 14 may be formed from any desired material. For example, they may be formed from paper, light cardboard or a plastic material. If a plastic material is used, it must be sufficiently flexible to permit it to be bent in a desired manner. Generally, paper or cardboard are preferred materials.

Each arm 14 is provided with an aperture 18 adjacent its outermost end 20 to facilitate assembly and disassembly of the top. A similar aperture 22 is provided in the base member 12, preferably at its geometric center. While it is preferred that the base member 12 have a substantially circular configuration, it should be recognized that the base member could have a wide variety of polygonal shapes.

The top 10 further comprises a stem member 24 having a relatively pointed end 26 which serves as the pivot for the top. The stem member 24 may be formed from any suitable relatively rigid material known in the art. For example, it could be formed from wood or plastic.

If desired, a protective tip 28 may be provided to prevent a user from being hurt by the end 26. The protective tip 28 may have any desired shape and may also be formed from any suitable material such as wood and plastic. Generally, the tip 28 has a bore 29 dimensioned and shaped to receive the pointed end 26 of the stem member. In addition to its safety function, the tip 28 can serve to retain the stem member 24 in position relative to the base member. For example, the tip 28 may have a surface 30 which contacts one of the base member's surfaces.

Figure 2:
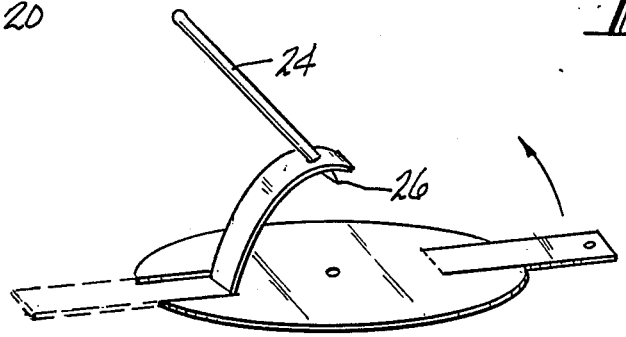
FIGS. 2–4 illustrate the manner in which the top of the present invention is assembled.
Figure 3:
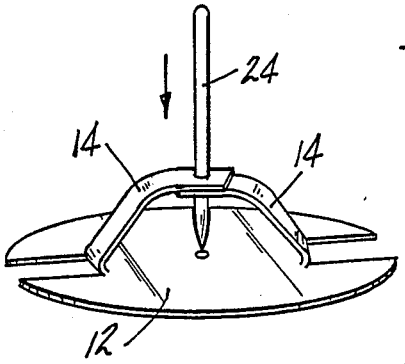
Figure 4:
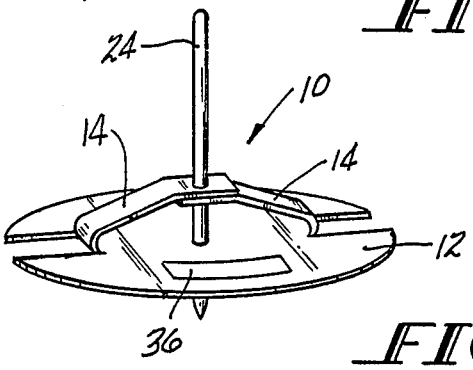
Figure 5:
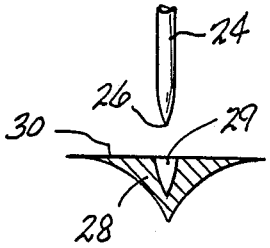
FIG. 5 illustrates a protective tip for the top.

To assemble the top 10, one of the arms 14 is bent into a desired configuration such as the arcuate shape shown in FIGS. 2–4. The stem member 24 is then inserted through the aperture 20 in the arm. Thereafter, the second arm is bent and the stem member 24 is inserted through its aperture. Finally, the stem member 24 is pressed through the aperture 22 in the base member. If provided, the protective tip 28 can be pressed or glued onto the pointed end or tip 26. The protective tip, if added, increases top spin time since it adds weight to the top. A finished version of a two arm top is illustrated in FIG. 4. As can be seen from this figure, the stem member holds the arms in a desired position relative to the base member while serving as a pivot for the top.

Figure 6:
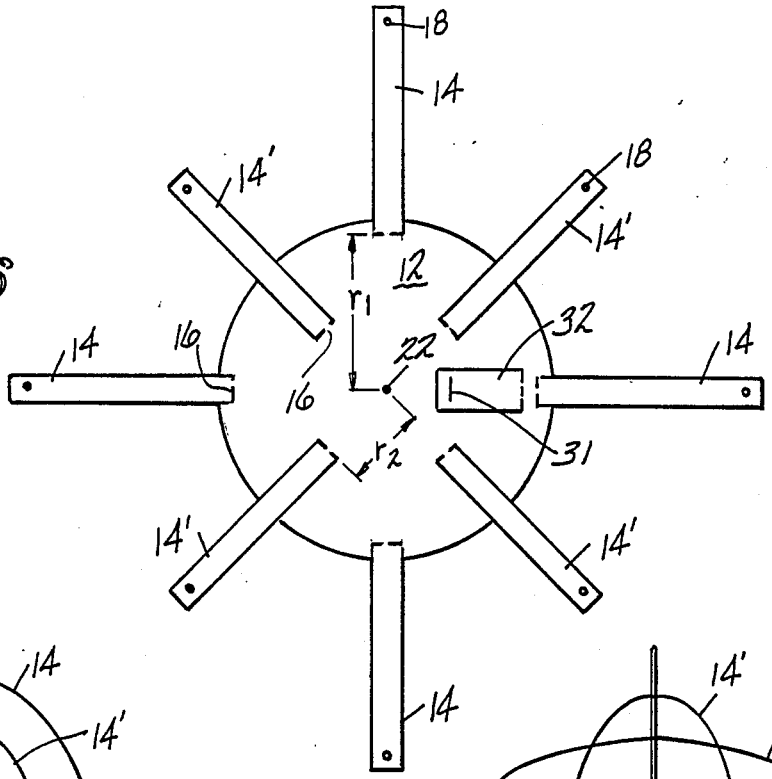
FIG. 6 illustrates an alternative base member and arm design.
Figure 10:
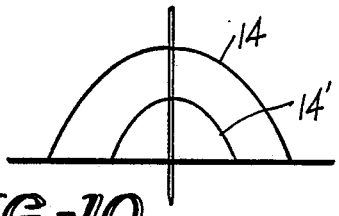
FIGS. 7–13 illustrate some of the top configurations which can be formed.
Figure 7:
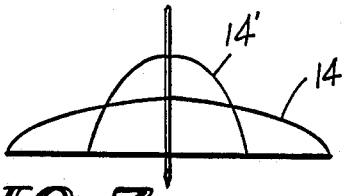
Figure 12:
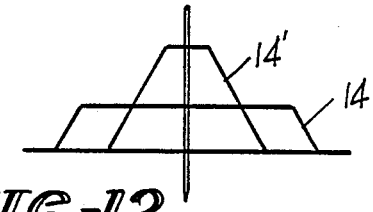
Figure 8:
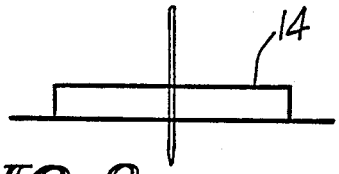
Figure 9:
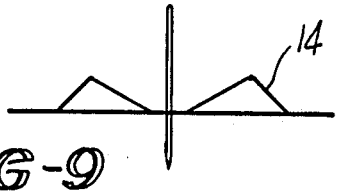

As previously discussed , the base member may have any number of arms about its periphery. FIG. 6 illustrates an embodiment in which the base member 12 has a first set of arms 14 having an end 16 joined to the base member and spaced a distance $r_1$ from the center of the base member and a second set or arms 14' having ends 16' spaced a distance $r_2$ from the center of the base member. In addition, a tab 32 may be provided for decorative purposes. A slit 31 may be provided in the tab to receive one or more of the arms. To assemble the top, one of the arms 14 is bent to a desired shape and a stem member 24 is inserted into its aperture 18. Thereafter, each of the arms is bent to a desired shape and the stem member is inserted therethrough. In the final step, the stem member is carefully passed through the aperture 22 in the base member.

FIGS. 7–13 illustrate some of the various silhouettes which can be obtained by bending the arms shown in the embodiments of FIGS. 1 and 6.

Figure 14:
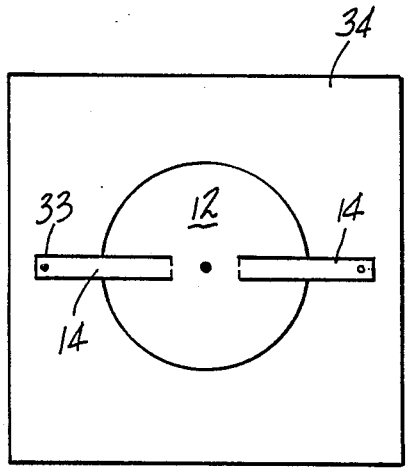
FIG. 14 illustrates a top view of a sheet containing a top pattern in accordance with the present invention.
Figure 11:
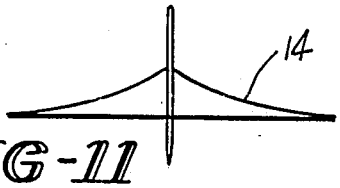
Figure 13:
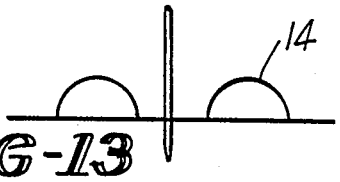

If desired, the top of the present invention may be used to market a wide variety of products. For example, the back of a food-containing box may comprise a die pattern having a multi-armed pattern such as the two-armed pattern shown in FIGS. 1 and 14. The two arm pattern may be cut out of the sheet 34 surrounding it using a scissor or a knife. Additional cuts can be made to separate the arms 14 along their longitudinal edges 33 from the base member 12. Alternatively, perforations not shown may be provided in the sheet 34 to facilitate removal of the two-arm pattern and separation of the arms 14 from the base member 12. The stem member may be packaged within the box along with color coordinated sticker(s) 36 to be adhesively mounted on the base member and/or the arms. The stickers and/or the top components may contained pre-printed indicia such as the name of a product thereon or may merely be colored.

Alternatively, small versions of the top could be marketed as a card which could be sent through the mail and assembled by the recipient. Special designs could be created for different occasions. For example, by providing six arms which could be bent above and below the base, a Christmas ornament could be produced which later can be used as a top.

Still further, a series of top designs could be published in book form. The book may be provided with a plurality of stems for use with the design. A large version of the top could as be published as a poster and sold flat with an attached stem member. The top could be included as a promotion on a record album cover or included as an insert in the record album or in a magazine.

As can be seen from the foregoing discussion, a top has been described which is relatively inexpensive to produce and easy to assembly. In addition to functioning as a toy, the top may be used as a promotional device for marketing various products.

It is apparent that there has been provided in accordance with this invention a paper spinning top which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A top which comprises:

a base member having an aperture;

at least two arms joined to said base member;

each said arm having an aperture adjacent its outermost end; and a stem member for inducing rotation of said top, said stem member having a first relatively pointed end which acts as a spin point for said top and a second end opposed to said first end which can be grasped by a user to induce said rotation, said stem member passing through said aperture in each said arm and said aperture in said base member and holding said arm in a spaced position relative to said base member.

2. A top according to claim 1 wherein:

said arms are equally spaced about said base member; and each said arm is joined to said base member at a second end opposed to said outermost end.

3. A top according to claim 1 wherein each said arm is a continuation of said base member.

4. A top according to claim 1 wherein said base member has a substantially circular shape and said base member aperture is located at the center.

5. A top according to claim 1 wherein said arms are formed from a flexible material.

6. A top according the claim 5 wherein said base member and said arms are formed from paper.

7. A top according to claim 5 wherein said base member and said are formed from cardboard.

8. A top according to claim 5 wherein said base member and said arms are formed from a plastic material.

9. A top according to claim 1 which further comprises at least one sticker adhesively affixed to at least One of said base member and said arms.

10. A top according to claim 1 further comprises printed indicia on at least one of said arms and said base member.

11. A top according to claim 1 further comprising a protective tip placed over said relatively pointed end of said stem member.

12. A top according to claim 1 which further comprises:

a first set of arms spaced about the periphery of said base member;

each said arm in said first set being joined to said base member at a first distance from the center of said base member;

a second set of arms spaced about the periphery of said base member; and each said arm in said second set being joined to said base member at a second distance form the center of said base member.

13. A top according to claim 12 wherein each arm is formed from a flexible and bendable material so as to facilitate the creation of a variety of shapes and silhouettes.

14. A top according to claim 1 which further comprises a substantially planar sheet containing said base member and said arms, said base member and said arms being removable from said sheet prior to assembly into said top.

15. A top according to claim 14 wherein said sheet forms part of a package.

16. A top according to claim 14 wherein said sheet forms a portion of a greeting card.

17. A process for forming a top which comprises:

providing a base member having at least two bendable arms joined to spaced apart portions of said base member;

providing a stem member having a first relatively pointed end which acts as a pivot for said top, said stem member being used to induce rotation of said top;

providing each arm and said base member with an aperture for receiving said stem member;

folding a first arm into a desired configuration;

passing said stem member through said aperture in said first arm;

passing said stem member through said aperture in each other arm; and passing said stem member through said aperture in said base member to hold said arm in a spaced position from said base member.

18. A process for forming a top according to claim 17 which further comprises:

removing said base member and said arms from a surrounding, substantially planar sheet prior to said folding step.

* * * * *